US007409935B2

(12) United States Patent
Lee et al.

(10) Patent No.: US 7,409,935 B2
(45) Date of Patent: Aug. 12, 2008

(54) METHOD AND APPARATUS FOR SETTING BIAS SPRING LOAD DURING ASSEMBLY OF A CAMSHAFT PHASER

(75) Inventors: Jongmin Lee, Pittsford, NY (US); Cai P. Shum, Mendon, NY (US)

(73) Assignee: Delphi Technologies, Inc., Troy, MI (US)

( * ) Notice: Subject to any disclaimer, the term of this patent is extended or adjusted under 35 U.S.C. 154(b) by 389 days.

(21) Appl. No.: 11/171,656

(22) Filed: Jun. 30, 2005

(65) Prior Publication Data

US 2007/0000462 A1 Jan. 4, 2007

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS 5,558,053 A * 9/1996 Tortul ..... 123/90.17
6,276,321 B1 8/2001 Lichti et al.

* cited by examiner

*Primary Examiner*—Zelalem Eshete
(74) *Attorney, Agent, or Firm*—Michael D. Smith

(57) ABSTRACT

A camshaft phaser includes a rotor, a stator, a torsional rotor bias spring, and a spring retainer wherein the spring retainer is fixed to either the rotor or stator when the nominal spring preload is reached to retain the nominal spring preload in said phaser. In one embodiment, the rotor has a bore formed therein, and the spring retainer has an arcuate slot coincident with the rotor bore. The spring retainer is rotated past the rotor until a predetermined spring preload is achieved. A retaining feature is installed through the arcuate slot into the rotor bore, thereby biasing the rotor in the predetermined bias position at the predetermined bias spring preload. In another embodiment, the spring retainer is a rotatable cam feature that becomes fixed to the stator after spring adjustment is complete.

15 Claims, 3 Drawing Sheets

METHOD AND APPARATUS FOR SETTING BIAS SPRING LOAD DURING ASSEMBLY OF A CAMSHAFT PHASER

TECHNICAL FIELD

The present invention relates to camshaft phasers for varying the valve timing of internal combustion engines; more particularly, to bias springs in camshaft phasers for biasing the rotor in a desired direction to a rest position; and most particularly, to method and apparatus for setting the load of a phaser bias spring during manufacturing to a predetermined level when presented with a population of springs having differing spring rates.

BACKGROUND OF THE INVENTION

Camshaft phasers for varying the timing of valves in internal combustion engines are well known. A typical phaser comprises a rotor attached to a camshaft and a stator driven in time by a sprocket or pulley connected to an engine crankshaft. The phaser is able to vary the rotary position of the rotor with respect to the stator and thus to vary the valve timing imposed by the camshaft with respect to the crankshaft and pistons.

It is known to include a bias spring within a camshaft phaser, disposed functionally between the stator and the rotor, to urge the rotor in a predetermined direction to a predetermined position with respect to the stator when the rotor is not otherwise directed. See, for example, U.S. Pat. No. 6,276,321 B1. It can also be used to bias camshaft friction torque. Such a predetermined position may be, for example, either fully advanced or fully retarded. Typically, the desired predetermined position is fully retarded for an intake phaser and fully advanced for an exhaust phaser, wherein a locking pin may be activated between the rotor and stator to fix the timing at engine nominal for certain phases of engine operation.

In one example of the prior art, during manufacturing assembly of a phaser, the bias spring is wound by a spring retainer to its design-specified position and a retaining feature is installed to hold the spring in place. The rotor and the spring retainer have matching openings for receiving the retaining feature, for example, a screw or a pop rivet, in a predetermined unique angular relationship between the rotor and the spring retainer. In another example of the prior art, during manufacturing of the phaser, one end of the torsional bias spring is grounded to a fixed feature of the rotor, which may be a cup shaped member extending axially from the rotor, while the other end of the torsional bias spring is grounded to a fixed feature of the stator. The fixed feature of the stator may be a head of a bolt used to fasten the phaser end cover to the stator. The fixed features of the rotor/stator set a predetermined unique relationship between the ends of the torsional bias spring and thus the biasing spring force between the rotor and stator. The intention of such assembly processes is to have the spring wound to a desired and predetermined spring load. However, experience with prior art phasers assembled in such fashion shows that significant and unacceptable variation in spring loading can occur because of variation in spring rate within a population of springs provided for the purpose. Because the rotary action of the rotor requires overcoming the force of the bias spring, the speed of rotor response will vary inversely with the strength of the bias spring: the stronger the spring, the slower the response, especially when the oil control valve is energized. When a phaser is applied, for example, to one bank of a V-style engine, it is calculated that a variation in bias spring load of +/−10% can create a transient valve timing offset between the banks of up to 25%, which is clearly undesirable and unacceptable.

One solution to the problem is to reduce the variability range of spring constants in the population of springs. This solution requires a much higher level of quality control in spring manufacture, resulting in more expensive springs and thus more expensive phasers.

What is needed in the art is a means for installing and retaining any of the springs in the population of springs to a predetermined spring load.

It is a principal object of the present invention to provide a plurality of camshaft phasers having identical loading of their bias springs.

SUMMARY OF THE INVENTION

Briefly described, a camshaft phaser includes a rotor, a stator, a torsional rotor bias spring, and a spring retainer attachable to the rotor. The rotor has a bore formed therein, and the spring retainer has an arcuate slot coincident with the rotor bore. During assembly, the rotor is positioned at a predetermined bias position within the stator (preferably fully retarded in the case of an intake phaser and fully advanced in the case of an exhaust phaser). The spring is installed with one end grounded to the stator and the other end grounded to the spring retainer. A torque transducer is attached to the spring retainer. The spring retainer is rotated past the rotor until a predetermined spring force is achieved. A retaining feature, such as a pop rivet, is installed through the arcuate slot into the rotor bore, thereby biasing the rotor in the predetermined bias position at the predetermined bias spring force. In a second embodiment, the spring is installed with one end grounded to the rotor and the other ended grounded to the stator. An adjustable feature associated with the rotor ground point is then used to adjusted the bias spring force to a predetermined level.

BRIEF DESCRIPTION OF THE DRAWINGS

The present invention will now be described, by way of example, with reference to the accompanying drawings, in which.

DESCRIPTION OF THE PREFERRED EMBODIMENTS

As described above, a problem in the prior art is that when camshaft phasers are fitted with bias springs having differing strengths, the response time of a phaser will vary according to the strength of the spring. A population of springs having a tolerance range of +/−10% around a mean spring constant will produce a population of phasers having a corresponding response time range.

Figure 1:
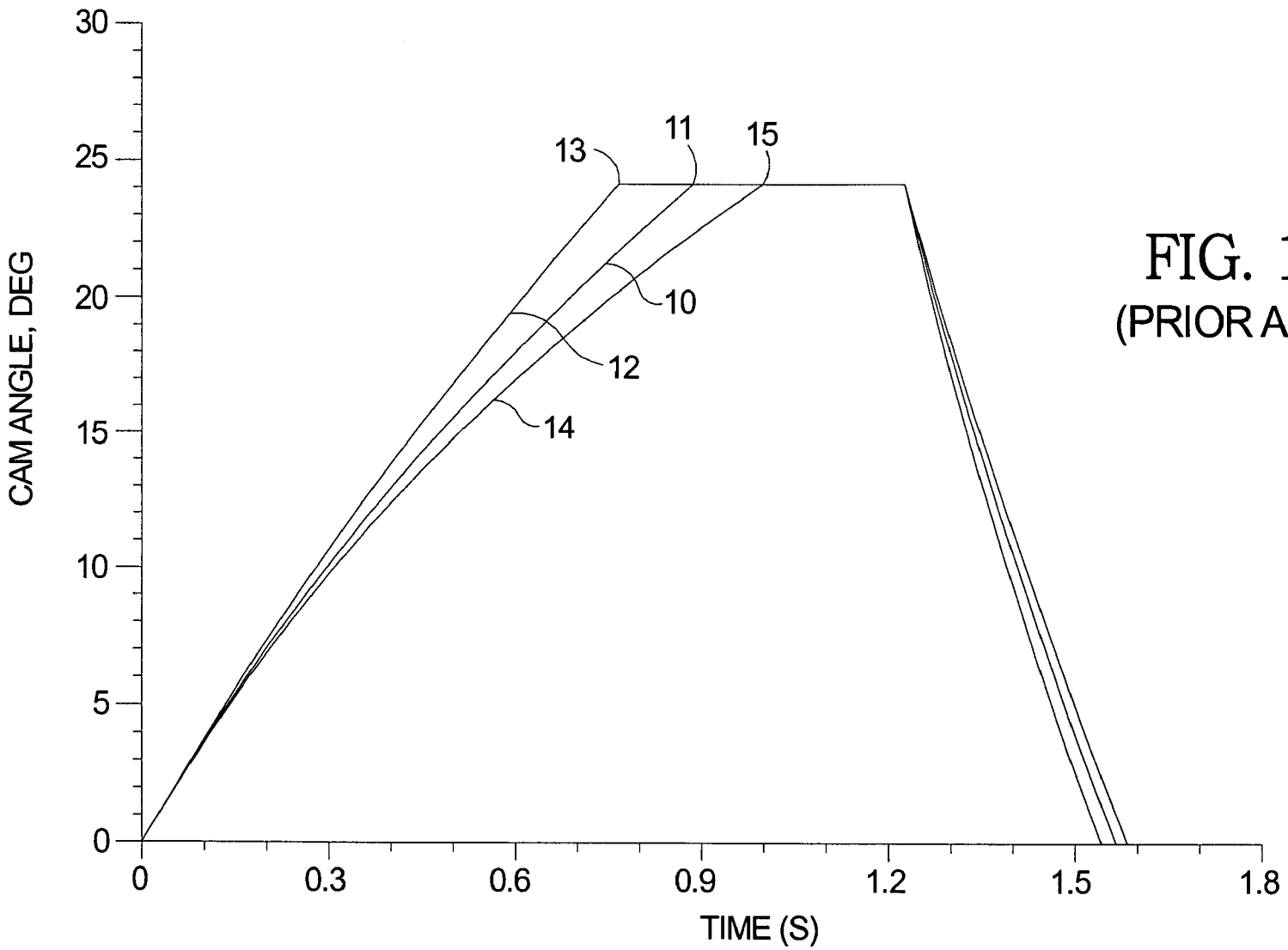
FIG. 1. (PRIOR ART)
FIG. 1 is a graph of cam angle as a function of response time for a cam phaser having a nominal spring load, a cam phaser having nominal−10% spring load, and a cam phaser having nominal+10% spring load.

Referring to FIG. 1, three response time curves are shown for three camshaft phasers having three different-strength springs. A response curve for nominal spring preload of 2.1 Nm is shown in Curve 10, wherein the response time 11 required to achieve a cam angle shift of 24° is about 0.9 seconds. When the spring load is 10% less (Curve 12), the response time 13 is about 0.8 seconds; and when the spring load is 10% greater (Curve 14), the response time 15 is about 1.0 seconds. Such variation can cause serious valve timing imbalances between a right bank and a left bank of a V-style engine. Thus it is the objective of the invention to overcome this variation and provide method and apparatus to permit each camshaft phaser to perform along a nominal performance curve and achieve a nominal camshaft angle displacement in a nominal time period.

Figure 2:
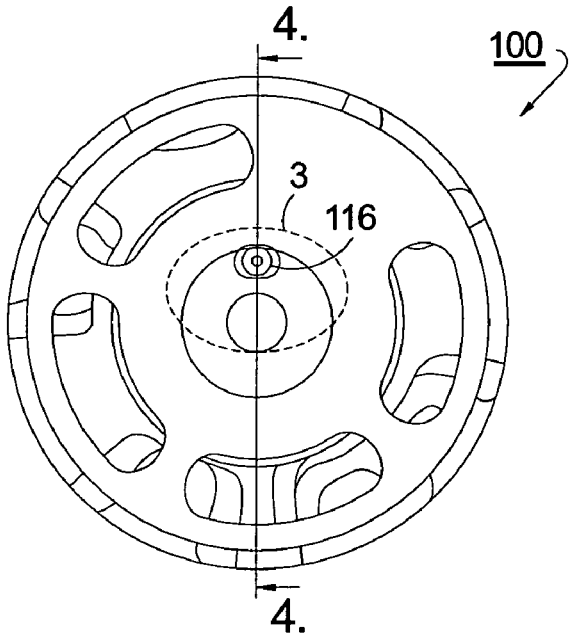
FIG. 2 is a plan view of a camshaft phaser in accordance with the invention.
Figure 3:
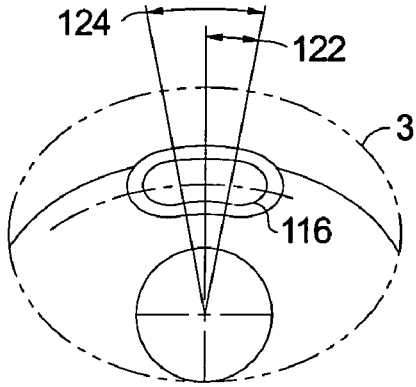
FIG. 3 is a detailed view taken in area 3 in FIG. 2.
Figure 4:
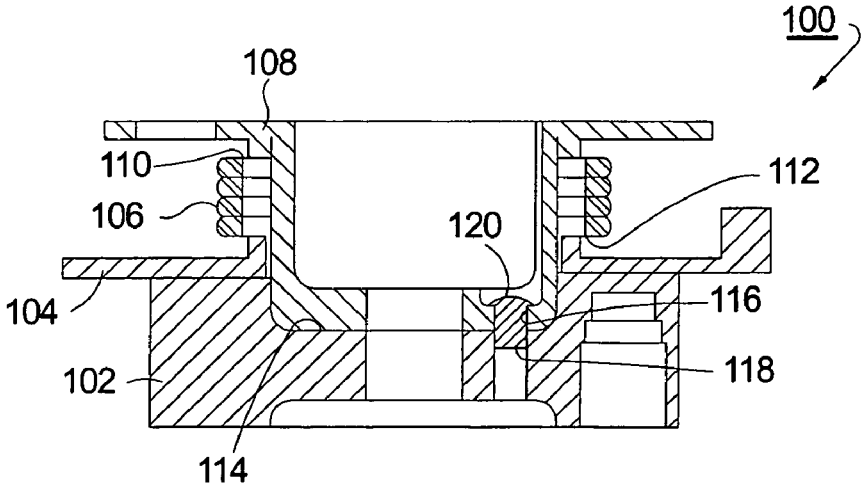
FIG. 4 is a cross-sectional view taken along line 4-4 in FIG. 2

Referring to FIGS. 2 through 4, an exemplary method and apparatus is shown for meeting the objective of the invention. A portion of a camshaft phaser 100 in accordance with the invention includes a rotor 102, a portion of a stator 104, such as a stator cover, a torsional bias spring 106, and a spring retainer 108. During assembly of phaser 100, spring 106 engages spring retainer 108 at a first end 110 and engages stator 104 at a second end 112. Preferably, retainer 108 is centered on, and initially rotatable on, rotor 102 by being disposed in a shallow well 114 therein. Spring tension is generated in spring 106 by rotating retainer 108 relative to rotor 102 in a predetermined direction to wind spring 106. In accordance with a novelty of the invention, during assembly of phaser 100, a torque meter (not shown) is utilized to monitor spring load as the spring is wound to its specified tension. Thus the spring is not wound to a predetermined angle as in the prior art but rather is wound to a predetermined tension; thus all camshaft phasers can have identical response curves and times. Spring retainer 108 is provided with an opening 116 and rotor 102 is provided with an aligned bore 118 for receiving a retainer 120, for example, a pop rivet, screw, or the like, by means of which the spring retainer 108 is fixed to rotor 102, after the predetermined torque of spring 106 is achieved. Of course, other means for fixing the retainer to the rotor, for example, spot welding, are fully comprehended by the invention.

Because of variation in the spring constants of a population of springs 106, in accordance with the invention opening 116 is formed as an arcuate slot, as shown especially well in FIG. 3. The central angle embraced by arcuate opening 116 is such that the position of retaining means may be varied angularly by a predetermined amount, for example, by +/−5° (half-angle 122 or full-angle 124). Thus, the capability of setting the spring load by varying the winding angle by +/−5°, which in the example is equivalent to +/−0.3 Nm, can effectively eliminate response variation due to spring variation in the spring population. Of course, the winding angle variation range may be more or less than +/−5° depending on the tolerance range of the bias spring used and the angular range of opening 116 provided to accommodate the spring tolerance range.

Figure 5:
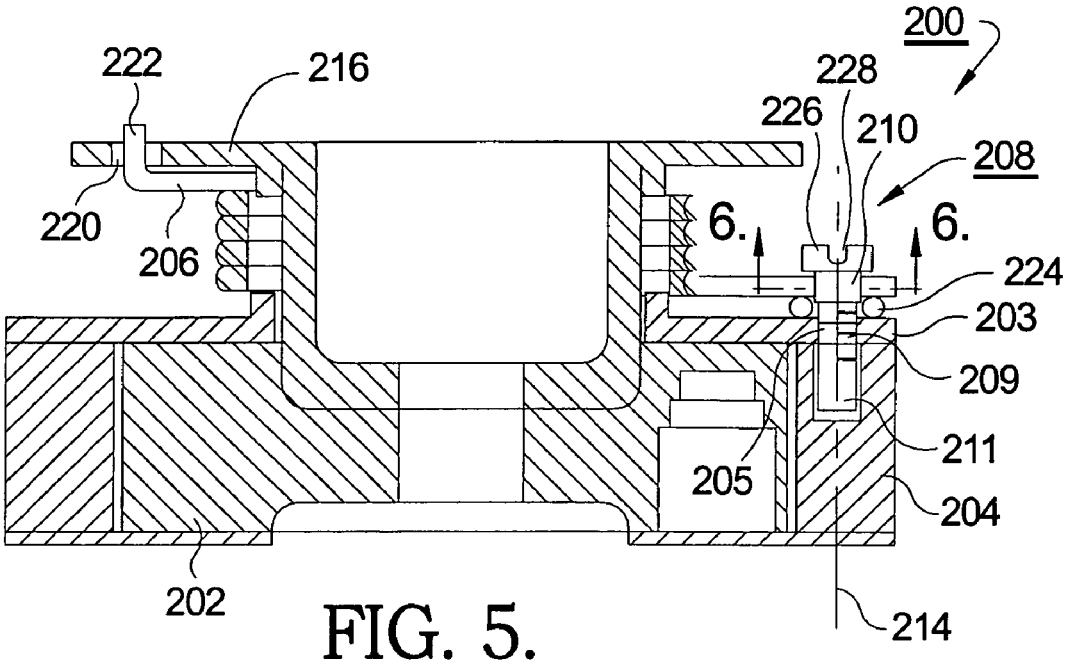
FIG. 5 is a cross-sectional view similar to the view of FIG. 4, showing a second embodiment in accordance with the invention.
Figure 6:
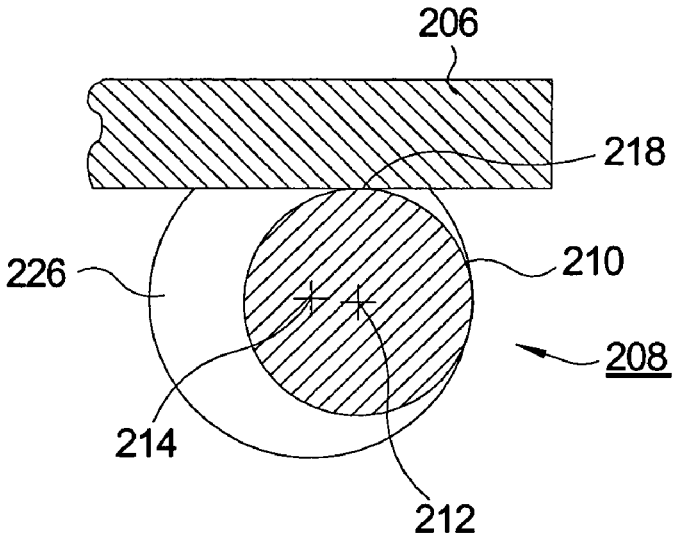
FIG. 6 is a cross-sectional view taken along line 6-6 in FIG. 5.

Referring to FIGS. 5 and 6, another exemplary method and apparatus is shown for meeting the objective of the invention. A portion of a camshaft phaser 200 in accordance with the invention includes a rotor 202, cup shaped rotor extension 216, a portion of a stator 204, a stator cover 203 having threaded bore 205, a torsional bias spring 206, and a spring retainer 208. Spring retainer 208 includes threaded portion 209 of shaft 211 for mating engagement with threaded bore 205, and eccentric 210 having an axis 212 offset from axis 214 of shaft 211. During assembly of phaser 200, spring 206 engages spring retainer 208 at a first end 218 and engages a notch 220 in cup shaped rotor extension 216 at a second end 222. Eccentric 210 functions as a cam lobe acting upon spring end 218 when retainer 208 is turned. Adjustment of spring tension in spring 206 is accomplished by rotating retainer 208 relative to stator 204, either clockwise or counter-clockwise, to cause eccentric 210 to act on spring end 218 to wind spring 206. In accordance with a novelty of the invention, during assembly of phaser 200, a torque meter (not shown) is utilized to monitor spring load as the spring is wound to its specified tension. Thus the spring is not wound to a predetermined angle as in the prior art but rather is wound to a predetermined tension; thus all camshaft phasers can have identical response curves and times. Spring retainer 208 is provided with jam nut 224 threaded to threaded portion 209 in order to lock retainer 208 from further rotation once spring tension is set. Of course, other means for fixing the retainer to the stator, for example, spot welding or gluing are fully comprehended by the invention. Head 226 is preferably formed 228 to receive a driving tool.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In a camshaft phaser, a method for setting a bias spring torque to a predetermined torgue value wherein a bias spring is operative between a rotor and a stator of said camshaft phaser, the method comprising the steps of:

a) fixing one end of said bias spring to a spring retainer;

b) fixing the other end of said bias spring to one of said stator and said rotor;

c) winding said bias spring by moving said spring retainer relative to said other end of said bias spring;

d) monitoring said bias spring torque during said winding;

e) stopping said winding when said predetermined torgue value of said bias spring torque is reached as a result of said monitoring step; and f) fixing said spring retainer to the other of said rotor and said stator to transfer said predetermined torque value between said rotor and said stator.

2. A method in accordance with claim 1 wherein step f) comprises fixing said spring retainer to said rotor to transfer said spring preload.

3. A method in accordance with claim 2 further including a phaser cover grounded to said stator and said bias spring is operative between said spring retainer and said cover.

4. A method in accordance with claim 1 wherein step f) comprises fixing said spring retainer to said stator to transfer said spring preload.

5. A method in accordance with claim 4 further including a phaser cover grounded to said stator and said bias spring is operative between said rotor and said cover.

6. A camshaft phaser comprising:

a) a stator;

b) a rotor rotatable in said stator;

c) a bias spring for angularly biasing said rotor within said stator;

d) a spring retainer for retaining said spring in said phaser; and e) a fastener for fixing said spring retainer to said rotor, said spring retainer including an arcuate slot for receiving said fastener, wherein said bias spring may be wound during assembly of said phaser by rotating said spring retainer, and wherein preload in said spring may be monitored during said winding thereof, and wherein said winding may be stopped when a predetermined nominal spring preload is reached, and wherein said spring retainer is fixed to said rotor when said nominal spring preload is reached to retain said nominal spring preload in said phaser.

7. A camshaft phaser in accordance with claim 6 wherein said fastener is selected from the group consisting of spot weld, screw, pin and pop rivet.

8. A camshaft phaser in accordance with claim 6 wherein the central angle of arcuate slot is about 10°.

9. A camshaft phaser in accordance with claim 6 wherein said spring retainer is fixed to said stator when said nominal spring preload is reached to retain said nominal spring preload in said phaser.

10. A camshaft phaser comprising:

a) a stator;

b) a rotor rotatable in said stator;

c) a bias spring for angularly biasing said rotor within said stator, said bias spring including a first end and a second end;

d) a spring retainer for retaining said spring in said phaser, said first end of said bias spring engaged with said spring retainer, said second end of said bias spring engaged with one of said rotor and said stator, said spring retainer including an arcuate slot defined therein; and e) a fastener for fixing said spring retainer to the other of said rotor and said stator at a predetermined torque value, wherein at least one of said spring retainer and the other of said rotor and said stator have an arcuate slot defined therein for receiving said fastener.

11. A camshaft phaser in accordance with claim 10 wherein said fastener is selected from the group consisting of spot weld, screw, pin and pop rivet.

12. A camshaft phaser in accordance with claim 10 wherein the central angle of arcuate slot is about 10°.

13. A camshaft phaser comprising:

a) a stator;

b) a rotor rotatable in said stator;

c) a bias spring for angularly biasing said rotor within said stator, said bias spring including a first end and a second end; and d) a spring retainer coupled with said stator and having a longitudinal axis, said spring retainer including an eccentric with an axis that is offset relative to said longitudinal axis, wherein said first end of said bias spring engaged with said eccentric of said spring retainer, wherein said second end of said bias spring engaged with said rotor, and wherein a bias spring torque of said bias spring is adjusted to a predetermined torque value by rotating said spring retainer relative to said stator.

14. A camshaft phaser in accordance with claim 13 wherein said rotor includes a rotor extension, and wherein said second end of said bias spring engaged with said rotor extension.

15. A camshaft phaser in accordance with claim 13 further comprising a jam nut engaged with said spring retainer to prevent said spring retainer from further rotation once said predetermined torque value is reached.

* * * * *